US007014894B2

(12) United States Patent
Yamamoto

(10) Patent No.: US 7,014,894 B2
(45) Date of Patent: Mar. 21, 2006

(54) INK JET RECORDING SHEET

(75) Inventor: Hirotaka Yamamoto, Shizuoka (JP)

(73) Assignee: Nisshinbo Industries, Inc., Chuo-ku (JP)

( * ) Notice: Subject to any disclaimer, the term of this patent is extended or adjusted under 35 U.S.C. 154(b) by 145 days.

(21) Appl. No.: 10/255,836

(22) Filed: Sep. 27, 2002

(65) Prior Publication Data

US 2003/0099817 A1 May 29, 2003

(30) Foreign Application Priority Data

Oct. 4, 2001 (JP) ..... 2001-308599

(51) Int. Cl.
*B41M 5/40* (2006.01)

(52) U.S. Cl. ..... 428/32.25; 428/32.3; 428/32.35; 428/32.37

(58) Field of Classification Search ..... 428/32.25, 428/32.3, 32.31, 32.36, 32.37, 32.35
See application file for complete search history.

(56) References Cited

U.S. PATENT DOCUMENTS 6,465,086 B1 * 10/2002 Kitamura et al. ..... 428/32.25
6,506,479 B1 * 1/2003 Horiuchi ..... 428/195.1
2005/0013948 A1 * 1/2005 Yamamoto ..... 428/32.34

FOREIGN PATENT DOCUMENTS

JP 11-147361 A 6/1999

* cited by examiner

*Primary Examiner*—B. Shewareged
(74) *Attorney, Agent, or Firm*—Smith Patent Office

(57) ABSTRACT

There is disclosed an ink jet recording sheet which comprises a substrate and an ink accepting layer composed of at least two layers on the substrate, characterized in that the ink accepting layer comprises at least one cracked layer having cracks in lower layers other than a surface layer (the layer farthest from the substrate) and a contact layer in contact with the cracked layer, wherein part of the contact layer cuts into the cracked layer, and the cracked layer contains a hydrophobic resin (e.g. styrene-acrylics copolymer resin) as a binder, or wherein the contact layer is formed by coating with a coating solution having viscosity of at most 3000 mPa.s and a proportion of solid content in the range of 10 to 30% by weight. The above ink accepting layer is excellent in water resistance and strength of adhesion among the interlayers, whereby the ink jet recording sheet as a whole becomes excellent in scratch-abrasion resistance under wet conditions as well as image density.

11 Claims, 1 Drawing Sheet

INK JET RECORDING SHEET

BACKGROUND OF THE INVENTION

1. Field of the Invention

The present invention relates to an ink jet recording sheet which is equipped with an ink accepting layer on a substrate. In particular, the present invention pertains to the ink jet recording sheet which is excellent in scratch-abrasion resistance under wet conditions and besides in image density, and in which the ink accepting layer is excellent in water resistance and adhesion strength.

2. Description of the Related Arts

In recent years, an ink jet recording system as one of image printing systems has expanded the fields of application by virtue of such advantages that high quality images are obtained with ease and the running cost is relatively low. In particular, there are steadily increasing demands on printing full-color images for use as a poster and the like. In the case of printing full-color images, an ink accepting layer having a relatively large thickness is required by reason of a sufficient ink absorption capacity being called upon.

However, since the liability to peeling off of the ink accepting layer increases with an increase in the thickness of the aforesaid layer, it is necessary to enhance the strength of adhesion to the substrate. Thus for the purpose of enhancing the strength of adhesion to the substrate, it is a customary practice to install an anchor coat layer between the substrate and the layer which is subjected to ink jetting. Nevertheless, the present situation is such that the working effect from the anchor coat layer is not satisfactory.

Moreover in the purpose of use as a poster or the like, the job of placing a notice outdoors is sometimes carried out in the rain, and accordingly the ink jet recording sheet is called upon to have not only water resistance but also scratch-abrasion resistance under wet conditions. Further in the case of a poster, importance is attached to image impression and its appealing power, and thereby the image is required to have a high density. However, nothing has hitherto been found which simultaneously satisfies both the requirements as mentioned above.

On the other hand, as a means for increasing the ink absorption capacity there is described in Japanese Patent Application Laid-Open No. 147361/1999 (Heisei 11), an ink jet recording body in which cracks are provided on at least one layer of lower layers other than a surface layer, and also disclosed therein a technique of filling in the cracks with a solvent or water and thereafter applying coating to form an upper layer.

Nevertheless, the above-mentioned ink jet recording body suffers from such drawback as low strength of adhesion between the lower layer having cracks and the upper layer in spite of its excellent ink absorption capacity.

SUMMARY OF THE INVENTION

In the light of the above-mentioned circumstances, a general object of the present invention is to provide an ink jet recording sheet in which an ink accepting layer composed of at least two layers is excellent in water resistance and adhesion strength, and which is excellent in scratch-abrasion resistance under wet conditions and besides in image density as a whole.

Other objects of the present invention will become obvious from the text of this specification hereinafter disclosed.

As a result of intensive extensive research and investigation accumulated by the present inventors in order to achieve the objects as mentioned before, it has been found that the objects can be achieved by an ink jet recording sheet which comprises a substrate and an ink accepting layer composed of at least two layers and placed on the substrate, characterized in that the ink accepting layer comprises at least one cracked layer which has cracks and is placed in lower layers other than a surface layer in the recording side (the layer farthest from the substrate) and a contact layer in contact with the cracked layer, wherein part of the contact layer cuts into the cracked layer, and the cracked layer contains a hydrophobic resin as a binder. The present invention has been accomplished by the above-mentioned findings and information.

Figure 1:
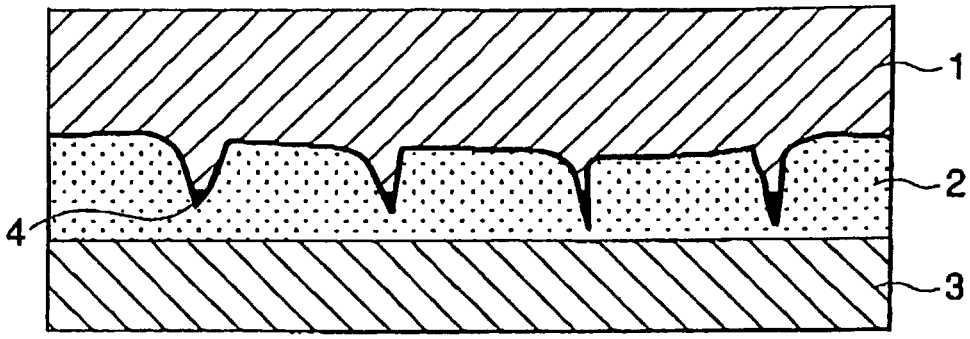
FIG. 1 is a cross sectional view showing an ink jet recording sheet according to the present invention, wherein a surface layer doubles as a contact layer.
Figure 2:
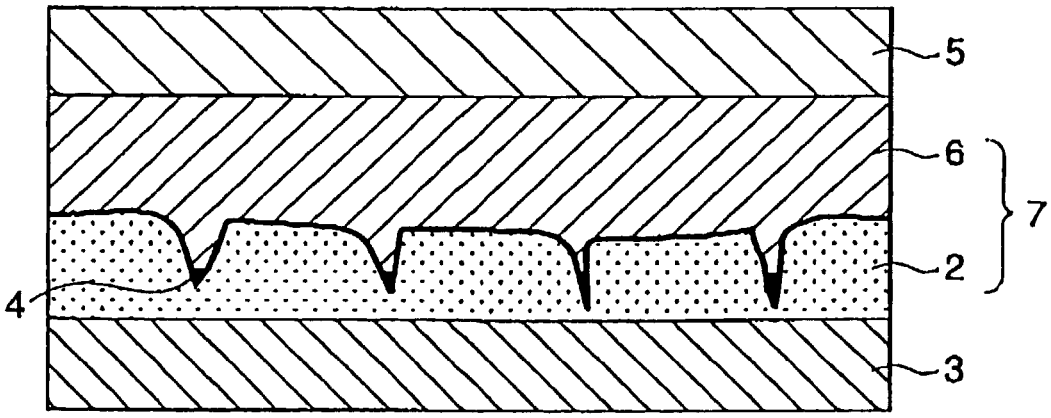
FIG. 2 is a cross sectional view showing an ink jet recording sheet according to the present invention, wherein one of lower layers constitutes a contact layer, in which the symbols shall have the following designations.

1: surface layer doubling as a contact layer, 2: cracked layer, 3: substrate, 4: voids, 5: surface layer, 6: contact layer, 7: lower layers.

DESCRIPTION OF THE PREFERRED EMBODIMENTS

The substrate to be used in the present invention is not specifically limited provided that it is in the form of sheet. For instance, various materials are usable as the above-mentioned substrate, including plastics films, paper, non-woven fabric and the like. Of these, plastics films are preferable in particular from the aspect of water resistance. Specifically, a thermoplastic resin for general purpose of use is preferable, including polyvinyl chloride, polyethylene terephthalate, polypropylene, polystyrene, polycarbonate and the like. Of these are preferable in particular, the above-cited thermoplastic resins incorporated therein with inorganic powders such as calcium carbonate and/or an organic pigment. There are also preferably usable thermoplastic resins in multi-layered film and in which microvoids are generated in the course of producing films. By the term plastics films as mentioned herein are meant to include synthetic paper, and are preferably subjected to corona discharge treatment or adhesion facilitation treatment for the purpose of improving adhesivity and/or leakage resistance.

The thickness of the substrate is not specifically limited, but can be properly and optionally selected in accordance with the purpose of use. For instance, the thickness thereof is preferably in the range of 50 to 200 micron, approximately in the case where the ink jet recording sheet is used for instance, to prepare a poster for general purpose.

The ink accepting layer in the present invention means all of layers that are installed for the purpose of accepting an ink. Of these, the layer which is located on the recording side and is farthest from the substrate is designated as a surface layer; and the layers other than the surface layer are each designated as a lower layer. The above-mentioned lower layer may be equipped at need with any of a plurality of well known ink accepting layers. The lower layer in contact with the substrate may be imparted with a function as an anchor coat for the purpose of enhancing adhesivity between the substrate and the lower layer. Alternatively, an anchor coat layer may be installed between the substrate and the lower layer.

It is indispensable in the present invention that at least one of the aforesaid lower layers be a cracked layer having cracks, and also that a contact layer in contact with the cracked layer be present. The contact layer needs only be in contact with the cracked layer. Moreover, the contact layer may exist in the lower layers as a layer different from the cracked layer. Alternatively, the surface layer may double as a contact layer.

The cracked layer in the present invention has a crack width of preferably in the range of 1 to 10 micron. Further it is preferable that the cracks run irregularly so that a lot of partitions are formed by the cracks constituting a contour, and that the size of one partition is in the range of 30 to 100 microns, approximately expressed in terms of peripheral length of the partition.

Further, it is indispensable in the present invention that part of the contact layer cut into the cracks of the cracked layer. The contact layer may cut into the cracks of the cracked layer in such a manner that the voids in the cracks may be filled in whole with part of the contact layer, or in such a manner that the voids in the cracks may be filled in part not in whole with part of the contact layer, thus leaving some voids therein. By the contact layer cutting into the cracks of the cracked layer it is made possible to enhance adhesivity between the cracked layer and the contact layer. It is preferable that part of the above-mentioned voids remain unfilled from the viewpoint of the working effect on increase in the ink absorption capacity and at the same time prevention of image bleeding.

The contact layer may have cracks as well. In the case where another contact layer exists coming in contact with the contact layer, it follows that the contact layer is imparted with the performance as a cracked layer as well with the proviso that part of the another contact layer cuts into the cracks of the contact layer. The aforesaid case is preferable because of enhanced strength of adhesion between the ink accepting layers. In addition, the surface layer (the layer farthest from the substrate) may be imparted with the function of protecting a lower layer.

In the meantime, the cracked layer contains a hydrophobic resin as a binder. By incorporating a hydrophobic resin into the cracked layer, it is made possible to manifest favorable image density. Various well known resins are usable as the hydrophobic resin and exemplified by styrene-acrylics copolymer resin, polyester resin and acrylics resin. Of these, the styrene-acrylics copolymer resin is preferable from the aspect of water resistance, easiness of forming cracks and the like factors. The use of a hydrophilic resin as a binder brings about unfavorable problems of not only deterioration in water resistance but also deterioration in image density on solid portion resulting from the banding (white streaky unprinted portion occurring in the width direction at the time of printing) which is caused by excessively high rate of ink absorption, thus limiting the expansion of dot diameter. In view of the foregoing, the binder for the cracked layer is composed of a hydrophobic resin in a proportion of preferably at least 80% by weight, most preferably 100% by weight.

The cracked layer in the present invention usually contains a filler in addition to the above-mentioned binder. The material of the filler is not limited to an organic material nor to an inorganic material, but is exemplified by calcium carbonate, silica, talc, clay, diatomaceous earth, aluminum hydroxide, polystyrene, polymethacrylate, titanium dioxide and fired kaolin. Of these, is preferable calcium carbonate which exerts the working effect of enhancing color development as well, most preferably in combination with the binder composed of the styrene-acrylics copolymer resin.

The ratio by weight of the filler to the binder F/R in the cracked layer is preferably in the range of 0.1 to 0.6, since the F/R, when being less than 0.1, leads to difficulty in the formation of cracks, whereas the F/R, when being more than 0.6, sometimes brings about deterioration in water resistance and strength of the cracked layer. In terms of the aforesaid working effect, the F/R is more preferably in the range of 0.2 to 0.4.

The cracked layer in the present invention is formed usually by applying a coating dispersion solution containing the hydrophobic resin and the filler, heating the resultant coat and drying the same, wherein the method for generating the cracks are available in a variety of ways without being limited in particular. It is usually possible to generate the cracks by regulating the ratio by weight of the filler to the binder and/or the temperature of the coating dispersion solution. In particular, cracks are more prone to be generated when the temperature of the coating dispersion solution is made lower than the glass transition temperature of the hydrophobic resin to be used as the binder. Each of the layers including the cracked layer can be formed by a well known coating method such as reverse roll coating, air knife coating, gravure coating and blade coating.

It is preferable in the present invention to allow the contact layer to sufficiently cut into the cracks of the cracked layer, and to provide voids each having an appropriate size. For the purpose thereof, it is preferable to apply coating so as to leave the aforesaid voids by controlling the applying conditions of the contact layer. Specifically it is made necessary not only to lower to some extent, the viscosity of the coating dispersion solution for forming the contact layer, but also to regulate the proportion of solid content of the aforesaid coating dispersion solution.

For instance, it is made possible to form moderate voids and thereby produce favorable ink jet recording sheets which have high adhesion strength and at the same time, are free from the problems on processing such as uneven coating by setting the viscosity of the coating dispersion solution for forming the contact layer on at most 3000 mPa.s and the proportion of solid content in the aforesaid coating dispersion solution on the range of 10 to 30% by weight.

As is the case with the cracked layer, the contact layer in the present invention usually contains both a filler and binder. As the filler for the contact layer, those exemplified in the above-mentioned cracked layer can be used. On the other hand, the binders therefor are not specifically limited, but exemplified by polyvinyl alcohol, polyvinyl butyral, gelatin, polyvinyl acetal, carboxymethyl cellulose, polyvinyl pyrrolidone, styrene-acrylics copolymer, ethylene-vinyl acetate copolymer, styrene-butadiene rubber, polyurethane resin, acrylic resin and the like.

It is preferable that the contact layer in the present invention contain a water-soluble cationic organic substance in addition to the filler and binder. The ink accepting layer is usually incorporated with a water-soluble cationic organic substance for the purpose of improving color development of ink and fixation thereof. However, the ink accepting layer suffers the shortcoming of deteriorating water resistance from the water-soluble cationic organic substance.

Notwithstanding the foregoing, it is possible in the present invention to incorporate the water-soluble cationic organic substance only into the contact layer substantially without incorporating the same into the cracked layer.

Accordingly, most of the water-soluble cationic organic substance exists on and around the surface of the ink accepting layer and thereby exhibits the working effect despite a small amount of the aforesaid substance as a whole. Such being the case, the content of the aforesaid substance can be suppressed to a low level, thus enabling the ink accepting layer to be enhanced in water resistance.

Moreover, it is preferable to use a porous filler as the filler for the contact layer from the viewpoint of enhancing the water resistance of the ink accepting layer. It is presumed that the porous filler encircles the water-soluble cationic organic substance in the porous portion, thereby bringing about the water resistance thereof. Further, it is preferable that the above-mentioned porous filler account for 40 to 80% by weight of the total solid content of the ink accepting layer, since the water resistance of the ink accepting layer is further enhanced thereby.

In addition, the effect on enhancement of the ink accepting layer is further assured by the binder of the cracked layer being a hydrophobic resin.

Furthermore, it is made possible in the present invention to improve the color development and fixation of an ink with a less amount of the water-soluble cationic organic substance by a method in which a coating dispersion solution substantially free from the water-soluble cationic organic substance is applied as coating to form the contact layer, followed by drying the resultant coat, and thereafter the foregoing substance is impregnated into the layer. In the above case, it is preferable that the coating dispersion solution to be applied for the first time for forming the contact layer be entirely free from the water-soluble cationic organic substance. Nevertheless the coating dispersion solution may be incorporated with the substance with the proviso that the substance is limited to a small amount, which is preferably at most 2% by weight expressed in terms of the proportion of solid content.

A method in which the water-soluble cationic organic substance is incorporated in advance into a coating dispersion solution is capable of uniformly distributing the substance in the contact layer. On the contrary, in the case of adopting the method in which the water-soluble cationic organic substance is impregnated after coating and drying, the substance, even if being permeated into the layer, remains at a comparatively upper portion of the layer, that is, a portion farther from the substrate and thereby is distributed principally at the upper portion of the layer. On the other hand, the water-soluble cationic organic substance which is contained at the upper portion of the layer is more effective than the substance which is contained at the lower portion thereof in terms of the function of improving color development of ink and fixation thereof. For the reason described hereinabove, the application of the method in which the water-soluble cationic organic substance is impregnated after coating and drying enhances water resistance with a relatively small amount of the substance. In the above-mentioned method in which the substance is incorporated in advance, when applied, a considerable amount of the substance is introduced in the bonding portion where the filler is bonded with the binder, whereas the method in which the substance is impregnated after coating and drying, when applied, the substance is added after the above-mentioned bonding portion is firmly formed, thereby preventing itself from entering the inside of the bonding portion. The foregoing is presumed to be the cause and factor of enhancing the water resistance of the contact layer.

It should be noted that in the present invention, the synergistical effect derived from the aforesaid method for enhancing the water resistance of the ink accepting layer and the working effect from the cracked layer gives rise to further excellent scratch-abrasion resistance under wet conditions of the ink accepting layer in whole.

It is preferable that the filler contained in the aforesaid contact layer be silica, where in at least 50% by weight thereof has a specific pore volume in the range of 0.9 to 1.5milliliter/gram and an average particle diameter of 5 microns or smaller as measured by coulter counter method. The above-mentioned properties additionally enhance the strength and water resistance of the ink accepting layer. In this case, the use of silanol-miodified polyvinyl alcohol as a binder is preferable in terms of further enhancement of the strength and water resistance thereof.

In summarizing the working effects and advantages of the ink jet recording sheet according to the present invention, the strength of adhesion between the contact layer and the cracked layer is enhanced by such constitution that part of the contact layer cuts into the cracked layer and at the same time, the water resistance of the ink accepting layer is improved by that the binder for the cracked layer is composed of a hydrophobic resin. The synergistical effect derived from the foregoing gives rise to further excellent scratch-abrasion resistance under wet conditions of the ink accepting layer in whole.

In general, excessively high rate of ink absorption leads to the occurrence of banding, which deteriorates the image density. In contrast with the foregoing the binder employed in the present invention which is composed of a hydrophobic resin suppresses the rate of ink absorption, and thereby manifests excellent image density.

In the following, the present invention will be described in more detail with reference to comparative examples and working examples, which however shall never limit the present invention thereto. The physical properties of the ink jet recording sheet obtained in the examples were determined by the procedures as described hereunder.

(1) Observation of Cracks and Cutting State of Contact Layer

Observations were made of the Cross Sectional Views of the Cracked Layer and Contact Layer by Means of a Scanning Type Electron Microscope.

(2) Adhesion Strength

A cellophane tape measuring about 10 cm in length was stuck onto the surface of a medium, which was then subjected to vigorous peeling off, when the feeling of resistance to peeling was evaluated by the following criterion.

○: very strong

Δ: strong

X: weak (3) Scratch-Abrasion Resistance Under Wet Conditions

The surface of a medium was rubbed with a sufficiently wet cotton bar so as to impose a load of 100 g thereonto until an ink accepting layer was eliminated off the medium, when the number of rubbing times was examined by counting both the ways as one time based on one way length of 50 cm, approximately.

(4) Image density

By the use of an ink jet printer available from Hewlett-Packard Co. under the Model No. DJ2000CP and a pure guaranteed pigment ink therefrom, single color solid printing was carried out for each color of CMYK. Thus visual observation was made whether or not banding occurred.

○: banding did not occur

Δ: some banding occurred without causing practical trouble

X: marked banding occurred causing practical trouble

EXAMPLE 1

A substrate with a thickness of 80 micron made of polypropylene available from Yupo Corporation under the Model No. FPG #80 was coated with a coating dispersion solution at a temperature of 20° C. comprising 60 parts by weight of hydrophobic binder as shown in Table 1 having a glass transition temperature of 26° C., 10 parts by weight of the filler as shown therein and 26 parts by weight of water, and thereafter dried at 110° C. to form a lower layer having a thickness after drying of 3 micron. Subsequently, the resultant lower layer was coated with a coating dispersion solution as shown in Table 2 having a viscosity of 400 mPa s, and thereafter dried to forma surface layer having a thickness after drying of 30 micron. Further, the resultant surface layer was coated with a coating dispersion solution for surface treatment containing a water-soluble cationic organic substance as shown in Table 3 in an amount of 1.2 g/m$^2$ expressed in terms of solid content so as to impregnate the solution thereinto to form an objective ink jet recording sheet. During the procedure, cracks occurred on the lower layer, and the surface layer doubling as a contact layer cut into the cracks. The coating dispersion solution for surface treatment permeated in the surface layer instead of forming a layer on the surface layer. Other evaluation results are given in Table 4.

EXAMPLE 2

The procedure in Example 1 was repeated to produce an ink jet recording sheet and evaluate the same except that the coating dispersion solution for the lower layer was altered to that comprising 60 parts by weight of hydrophobic binder as shown in Table 1 having a glass transition temperature of 45° C., 10 parts by weight of the filler as shown therein and 26 parts by weight of water. As was the case with Example 1, cracks occurred on the lower layer, and the surface layer doubling as a contact layer cut into the cracks. The coating dispersion solution for surface treatment permeated in the surface layer instead of forming a layer on the surface layer. Other evaluation results are given in Table 4.

COMPARATIVE EXAMPLE 1

The procedure in Example 1 was repeated to produce an ink jet recording sheet and evaluate the same except that the temperature of the coating dispersion solution for the lower layer was set on 30° C. instead of 20° C. As a result, cracks hardly occurred on the lower layer, and the coating dispersion solution for surface treatment permeated in the surface layer instead of forming a layer on the surface layer. Other evaluation results are given in Table 4.

COMPARATIVE EXAMPLE 2

The procedure in Example 1 was repeated to produce an ink jet recording sheet and evaluate the same except that the coating dispersion solution for the lower layer was altered to that comprising 60 parts by weight of hydrophilic binder as shown in Table 1 having a glass transition temperature of 50° C., 10 parts by weight of the filler as shown therein and 26 parts by weight of water. As was the case with Example 1, cracks occurred on the lower layer, and the surface layer doubling as a contact layer cut into the cracks. The coating dispersion solution for surface treatment permeated in the surface layer instead of forming a layer on the surface layer. Other evaluation results are given in Table 4.

COMPARATIVE EXAMPLE 3

The procedure in Example 1 was repeated to produce an ink jet recording sheet and evaluate the same except that the lower layer which had been coated and dried was subjected to water coating (20 g/m$^2$), and thereafter was coated with the coating dispersion solution as shown in Table 2. As was the case with Example 1, cracks occurred on the lower layer, but the surface layer doubling as a contact layer did not cut into the cracks. The coating dispersion solution for surface treatment permeated in the surface layer instead of forming a layer on the surface layer. Other evaluation results are given in Table 4.

TABLE 1

| | | Name of substance | Maker name/ commodity name | Solid content (%) | Wt ratio of solid (%) |
|---|---|---|---|---|---|
| Example 1 | binder | styrene-acrylics copolymer resin | BASF Dispersions Co.,Ltd./ Acronal YJ-6221D | 49 | 74.62 |
| | filler | calcium carbonate (aragonite type) | Shiraishi Central Laboratories Co., Ltd./ CAL.LIGHT-SA | 100 | 25.38 |
| Example 2 | binder | styrene-acrylics copolymer resin | BASF Dispersions Co.,Ltd./ Acronal YJ-2730D | 47 | 73.82 |
| | filler | calcium carbonate (aragonite type) | Shiraishi Central Laboratories Co., Ltd./ CAL.LIGHT-SA | 100 | 26.18 |
| Comp'tive Example 2 | binder | mixed solution of PVA and acrylic acid-ester copolymer | SHIN -NAKAMURA CHEMICAL Co., LTD./ New Coat PV-412 | 47 | 73.82 |
| | filler | calcium carbonate (aragonite type) | Shiraishi Central Laboratories Co., Ltd. CAL.LIGHT-SA | 100 | 26.18 |

{Remarks} PVA: polyvinyl alcohol Comp'tive: Comparative

TABLE 2

| Name of substance | Maker name/ commodity name | loading (wt · parts) | Solid content (%) | Wt ratio of solid(%) | Remarks |
|---|---|---|---|---|---|
| PVA(binder) | Kuraray Co., Ltd./ Kuraray R polymer R-1130 | 83.3 | 6 | 33.85 | Silanol/ modified |
| fluorescent whitening agent | Bayer AG/ Blankofor BSU-PN Liquid | 0.2 | 100 | 1.35 | |
| hydrated aluminum oxide (filler) | Nissan Chemical Industries Ltd./ALUMINAS OL 200 | 2.3 | 10 | 1.56 | fibrous |
| hydrated aluminum oxide (filler) | Catalysts & Chemicals Ind. CO., Ltd./ Cataloid AS-2 | 5.4 | 10 | 3.66 | sheet |
| Defoamer | San Nopco Ltd./ SN Deformer 480 | 0.2 | 100 | 1.35 | |
| synthetic silica | Fuji Silysia Chemical Ltd./ SYLYSIA 440 | 6.1 | 100 | 41.3 | a.p.d.[1]; 3.5 μm p.v.[2]; 1.25 mL/g |
| synthetic silica | W.R.Grace & Co. / SYLOJET P412 | 2.5 | 100 | 16.93 | a.p.d.[1]; 12.0 μm p.v.[2]; 2.00 mL/g |

{Remarks}

1): average particle diameter measured by coulter counter method, μm:micronmeter 2): pore volume, mL: milliliter

TABLE 3

| Name of substance | Maker name/ commodity name | loading (wt · parts) | Solid content(%) |
|---|---|---|---|
| dicyandiamide condensate | Nicca Chemical Co.,Ltd./ Neofix E-117 | 17 | 50 |
| water | | 83 | 0 |

TABLE 4

| Evaluation method | Example 1 | Example 2 | Comp'tive Example 1 | Comp'tive Example 2 | Comp'tive Example 3 |
|---|---|---|---|---|---|
| adhesion strength | ○ | ○ | Δ | Δ | x |
| scratch-abrasion resistance under wet conditions | 150 times | 150 times | 80 times | 10 times | 50 times |
| image density | ○ | ○ | ○ | x | ○ |

{Remarks} Comp'tive: Comparative

What is claimed is:

1. An ink jet recording sheet comprising:

a substrate;

at least one cracked layer disposed on the substrate, the at least one cracked layer having cracks therein; and a contact layer disposed on the at least one cracked layer, a portion of the contact layer being disposed in a portion of the at least one cracked layer, and wherein the at least one cracked layer includes a hydrophobic resin binder;

wherein the contact layer includes a binder, a silica filler, of which at least 50% by weight has a specific pore volume in the range of 0.9 to 1.5 milliliter/gram and an average particle diameter as determined by coulter counter method of at most 5 microns and a water-soluble cationic organic substance.

2. The ink jet recording sheet according to claim 1, wherein the contact layer is a surface layer.

3. The ink jet recording sheet according to claim 1, wherein the at least one cracked layer further includes a filler, wherein the ratio by weight of the filler to the binder (F/R) is in the range of 0.1 to 0.6.

4. The ink jet recording sheet according to claim 2, wherein the at least one cracked layer further includes a filler, wherein the ratio by weight of the filler to the binder (F/R) is in the range of 0.1 to 0.6.

5. The ink jet recording sheet according to claim 3, wherein the hydrophobic resin binder is styrene-acrylics copolymer resin, and the filler is calcium carbonate.

6. The ink jet recording sheet according to claim 4, wherein the hydrophobic resin binder is styrene-acrylics copolymer resin, and the filler is calcium carbonate.

7. The ink jet recording sheet according to any one of claims 1 to 6, further comprising an unfilled void disposed adjacent to the portion of the contact layer disposed in the portion of the at least one cracked layer.

8. The ink jet recording sheet according to claim 1, wherein the binder in the contact layer is silanol-modified polyvinyl alcohol.

9. The ink jet recording sheet according to claim 1, wherein the contact layer is formed by coating with a coating dispersion solution substantially free from a water-soluble cationic organic substance, drying the resultant coat and thereafter impregnating a water-soluble cationic organic substance into the coat.

10. The ink jet recording sheet according to claim 1, wherein the silica filler is included in the contact layer in an amount in the range of 40 to 80% by weight based on the total solid content.

11. The ink jet recording sheet according to any one of claims 8 to 10, further comprising an unfilled void disposed adjacent to the portion of the contact layer disposed in the portion of the at least one cracked layer.

* * * * *